US005108337A

United States Patent [19]

Sloan et al.

[11] Patent Number: 5,108,337

[45] Date of Patent: Apr. 28, 1992

[54] INFLATABLE BALLOON SYSTEM

[76] Inventors: John D. Sloan, 1607 N. Channel Dr., Round Lake Beach, Ill. 60073; Allan P. Newman, 4229 Highland, Arlington Heights, Ill. 60008; Stanley S. Budzinski, 50 N. 235 Itasca Rd., Addison, Ill. 60101

[21] Appl. No.: 609,412

[22] Filed: Nov. 5, 1990

[51] Int. Cl.[5] ..... A63H 3/06; A63H 17/44; B65D 83/00

[52] U.S. Cl. ..... 446/220; 446/224; 446/483; 222/402.14

[58] Field of Search ..... 446/220, 224, 485, 221, 446/222, 223, 225, 226, 267, 475, 483; 222/402.14

[56] References Cited

U.S. PATENT DOCUMENTS

| | | | |
|---|---|---|---|
| 3,154,223 | 10/1963 | Messmer | 222/402.14 |
| 3,174,455 | 4/1963 | Peterson | 446/220 X |
| 3,187,712 | 9/1963 | Pritchard et al. | 116/210 |
| 3,419,361 | 11/1965 | Bratton et al. | 116/210 X |
| 3,611,623 | 2/1970 | Copstead | 446/220 |
| 4,013,035 | 3/1977 | Kopeika | 116/210 |
| 4,020,786 | 5/1977 | Kopeika | 116/210 |
| 4,044,711 | 8/1977 | Jamison et al. | 116/210 |
| 4,088,162 | 5/1978 | Rossi | 116/210 |
| 4,277,004 | 7/1981 | Barlics | 222/402.14 |
| 4,416,433 | 11/1983 | Bellina | 116/210 |
| 4,440,325 | 4/1984 | Treuhaft et al. | 222/402.14 |
| 4,586,456 | 5/1986 | Forward | 446/220 X |
| 4,785,977 | 11/1988 | Ball | 222/402.14 X |
| 4,857,029 | 8/1989 | Dierick et al. | 446/220 |
| 4,898,561 | 2/1990 | Nottingham et al. | 446/220 |
| 4,901,664 | 2/1990 | Labrecque | 446/220 X |
| 4,903,958 | 2/1990 | DiCarlo et al. | 446/220 |
| 4,917,041 | 4/1990 | Weiswurm et al. | 446/224 X |
| 4,920,674 | 5/1990 | Shaeffer | 446/220 X |

FOREIGN PATENT DOCUMENTS

| | | | |
|---|---|---|---|
| 8002829 | 12/1980 | PCT Int'l Appl. | 222/402.14 |

*Primary Examiner*—Robert A. Hafer
*Assistant Examiner*—D. Neal Muir
*Attorney, Agent, or Firm*—Schiff, Hardin & Waite

[57] ABSTRACT

An inflatable balloon system comprises an optional first container having an openable top and a collapsed balloon positioned within the first container. A compressed gas container having a gas release valve is provided, with the compressed gas container and release valve being sealed entirely within the collapsed balloon. The gas release valve faces the openable top. Upon opening of the top, one can actuate the gas release valve through the wall of the balloon, to release the compressed gas and to cause inflation of the balloon.

7 Claims, 1 Drawing Sheet

Fig. 1
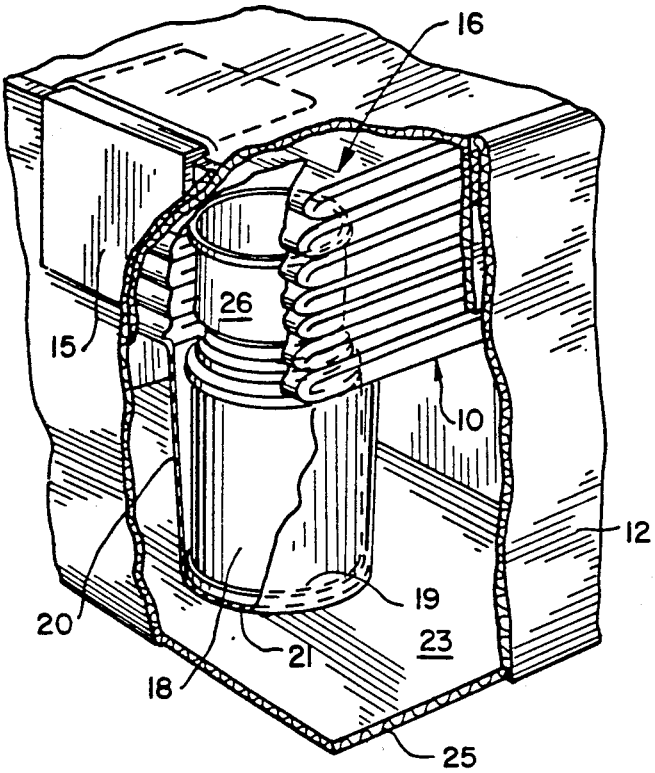
Fig. 3
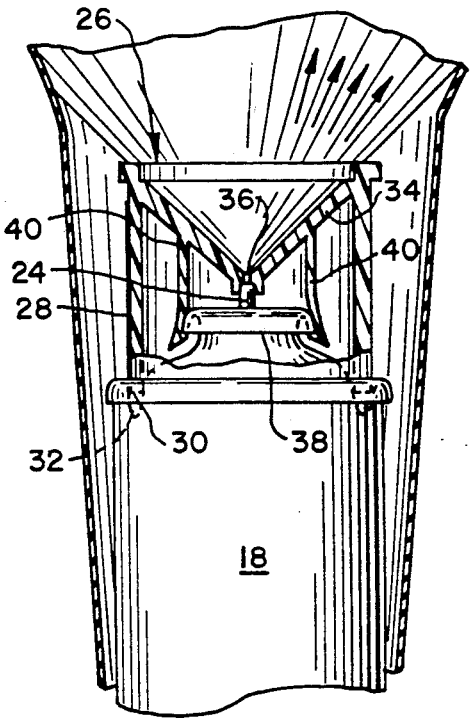
Fig. 2
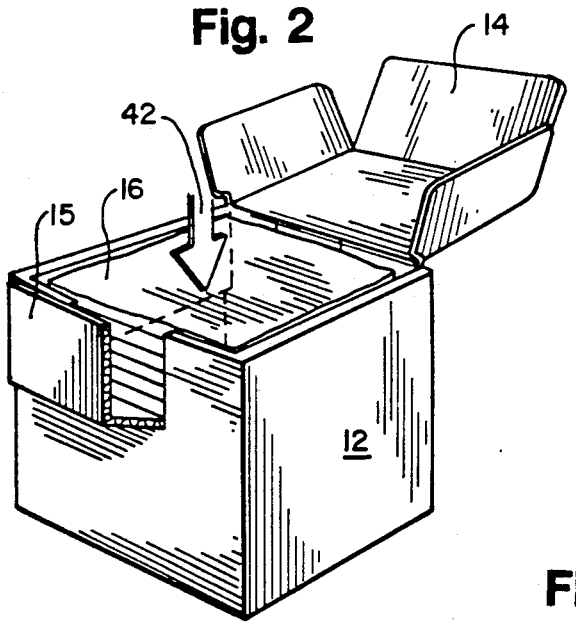
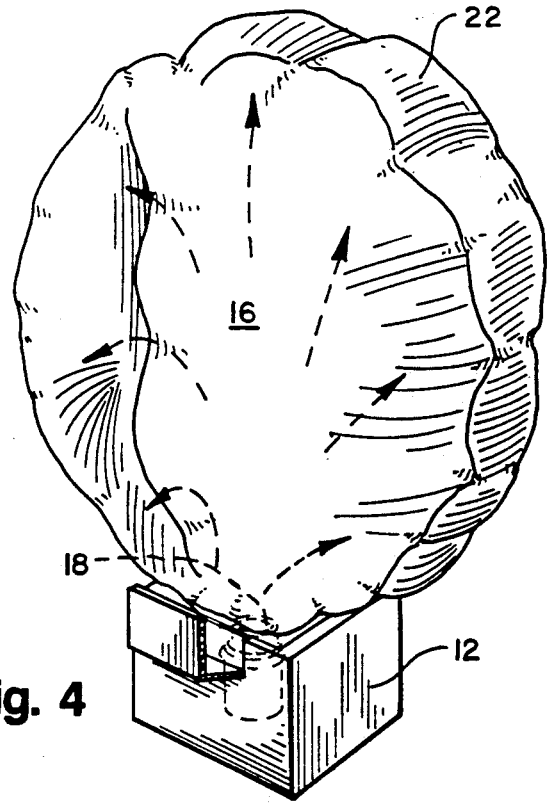
Fig. 4

INFLATABLE BALLOON SYSTEM

BACKGROUND OF THE INVENTION

This invention relates to an inflatable balloon system, which may be used as a toy or provided as a novelty gift item, a visual indicator, or the like.

Inflatable balloon systems are well known, being illustrated by DiCarlo et al. U.S. Pat. No. 4,903,958 and Copstead U.S. Pat. No. 3,611,623, for example.

In systems where a balloon is attached to a compressed gas container for later inflation, there is a technical problem of ensuring that the balloon does not prematurely detach from the container, particularly during the inflation process. And in other systems, after the balloon has been inflated, the outside compressed gas container remains as an encumbrance to the balloon, interfering with its full use in various aspects, for example as a decorative toy. If the user tries to disconnect the balloon from the container, once again the balloon may suddenly deflate. Also, apparatus that permits the separation of a balloon from its inflation container can be rather expensive and undesirable, and may fail in its function.

In accordance with this invention, an inflatable balloon system is provided in which the balloon may be readily separated from its package without any need for disconnecting a compressed gas container which is used to inflate the balloon, while the balloon may be packaged in a container. Upon actuation of the attached compressed gas container to release the gas into the balloon, the balloon may pop out of the container as a free-standing balloon, unconnected with any exterior connection.

DESCRIPTION OF THE INVENTION

In accordance with this invention, an inflatable balloon system comprises a first container having an openable top, although if desired the balloon may be provided free of such a first container. The balloon is typically initially in collapsed form, and is positioned within the first container when such a container is used. A compressed gas container is also provided, having a gas release valve. The compressed gas container and release valve are sealed entirely within the collapsed balloon. Typically, the gas release valve, when the balloon is in a first container, faces the openable top of the first container. Upon opening the top, one can actuate the gas release valve through the wall of the balloon to release the compressed gas and to cause inflation of the balloon.

The compressed gas container and release valve are thus located inside the balloon, which may be of spherical or other shape and completely sealed about the entire balloon periphery. The balloon itself may be a completely sealed structure, without any outward projections if desired, and with the emptied, compressed gas container serving as a ballast for the balloon. To inhibit the container from falling over, the container can be seated in a shallow well or recess located in the first container bottom.

Any desired gas may be used to inflate the balloon including compressed air, nitrogen, helium, carbon dioxide, or the like. Preferably, means are provided to retain the gas release valve in an actuated position once the valve is operated.

The compressed gas container typically has a valve stem as part of the gas release valve, and a valve cap carried on the compressed gas container engages the valve stem. Thus, pushing the valve cap actuates the valve stem. To retain the gas release valve in its actuated position once the valve is actuated, the container may have a curled, rearwardly-facing flange surrounding the valve stem, as is well known. The valve cap has hooked, snap-fit arms that engage the flange when the valve cap is pushed into position to actuate the valve stem. Thus the valve cap and valve stem are retained in their valve-actuated positions.

Accordingly, an inflatable balloon system is provided, which may be independent of any balloon container or box, although it may also be used with and in such a container. A balloon with an uninterrupted outer wall may be provided, free of any outward projections such as an inflation port or the like, since the balloon is completely sealed with the inflation means carried within it. Such a balloon can have better-than-ordinary gas-holding characteristics, since there is no inflation port in the balloon through which leakage can take place. To encourage the inflation means to remain upright in the balloon and box, the inflation means can be positioned within a shallow well in the box bottom.

DESCRIPTION OF DRAWINGS

In the drawings, FIG. 1 is a fragmentary, perspective view, with portions broken away, of the inflatable balloon system of this invention positioned within a box;

FIG. 2 is a complete perspective view showing the box of FIG. 1 in opened condition;

FIG. 3 is a fragmentary sectional view showing how the compressed gas container, having its valve cap depressed, is locked to hold the valve stem in valve-open position to inflate the balloon; and FIG. 4 is a perspective view showing the inflated balloon inflating out of its box, in free, unconnected relation thereto.

DESCRIPTION OF SPECIFIC EMBODIMENTS

Referring to FIGS. 1 and 2, an inflatable balloon system 10 is disclosed, being carried in a standard cardboard box 12. Box 12 defines an openable lid 14. When the lid 14 is opened, a sleeve 15 is exposed. Under sleeve 15 is a balloon 16, which is in a folded array. Also, balloon system 10 includes a compressed gas container 18, which may be of conventional design, located entirely within the collapsed balloon 16. Preferably, some portion of compressed gas container 18 is sealed to the wall 20 of balloon 16. To encourage gas container 18 to remain upright in box 12, the container 18 can be emplaced in a shallow well 19 formed by a hole 21 in a space 23 located just atop the box bottom 25.

Balloon 16 may be completely sealed, so that it may be inflated without an inflation port. Typically, this sealing may take place along a peripheral sealing line 22, (FIG. 4) with the balloon comprising, for example, a pair of circular sheets sealed together at seal line 22. However other designs for balloon 16 and other methods of sealing may be used as well.

As particularly shown in FIG. 3, compressed gas container 18 may define a valve stem 24. This valve and stem, and the compressed gas container 18, all may be of generally conventional design.

A plastic valve cap 26 rests on container 18. Cap 26 has an outer cylindrical portion 28 with a lower annular edge 30 that can be wedged into annular recess 32 of container 18, so as to preliminarily retain the cap 26 in a ready position.

Valve cap 28 also includes an inner, conical portion 34 which engages valve stem 24 and defines an aperture 36. This aperture permits release of compressed gas through valve stem 24, when valve stem 24 is depressed by cap 28. Also, as shown particularly in FIG. 3, compressed gas container 18 defines a curled, rearwardly facing flange 38 of conventional design surrounding valve stem 24. Valve cap 26 defines hooked, snap-fit arms 40 that engage flange 38 when the valve cap 26 is pushed into position to actuate valve stem 24. Thus, valve cap 26 is retained in its valve-actuating position, once it is pushed into such position for the first time, by snap-fit arms 40 so that the pressurized contents of container 18 can completely be expelled to inflate the surrounding balloon.

The inflatable balloon system 10 may be packed in a carton 12 as shown in FIGS. 1 and 2. Upon opening of the top of carton 12, a sleeve 15 is exposed. If desired, sleeve 15 may bear a legend such as "STOP. PRESS HARD HERE AND THEN RELEASE." When the user presses downwardly on the sleeve 15 and folded balloon 16 as illustrated by arrow 42 in FIG. 2, valve cap 26 is pushed down into the valve-open, gas-discharge configuration shown in FIG. 3. The depressed valve stem 24 then inflates balloon 16 as particularly shown in FIG. 4, so that balloon 16 comes free of box 12, and sloughs off sleeve 15. All that is required for balloon inflation is to press downwardly on cap 26 through sleeve 15 and balloon 16, and the balloon 16 spontaneously inflates.

The above is offered for illustrative purposes only, and is not intended to limit the scope of the invention of this application, which is defined by the claims below.

What is claimed is:

1. An inflatable balloon system, which comprises, a first container having an openable top and a bottom opposite said openable top;

a collapsed balloon positioned within said first container;

a compressed gas container having a gas release valve, said compressed gas container and release valve being sealed entirely within said collapsed balloon, said release valve being oriented toward said openable top; and means disposed in said container bottom for positioning said balloon, compressed gas container and release valve such that said valve is actuated by pressing the valve from outside of the balloon in the direction from the top of the box to the bottom of the box.

2. The inflatable balloon system of claim 1 in which holding means are provided to retain said gas release valve in a gas-delivering actuated position once the valve is actuated.

3. The inflatable balloon system of claim 1 in which said gas container defines a valve stem as said gas release valve, and a valve cap carried on said container and engaging said valve stem, whereby pushing of said valve cap actuates said valve.

4. The inflatable balloon system of claim 1 including a sleeve member between said openable top and said balloon.

5. An inflatable balloon system, which comprises:

a first container having an openable top and a bottom opposite said openable top;

a collapsed balloon positioned within said first container;

a compressed gas container having a gas release valve, said compressed gas container and release valve being sealed entirely within said collapsed balloon, said release valve being oriented toward said openable top;

means disposed in said container bottom for positioning said balloon, compressed gas container and release valve such that said valve is actuated by pressing the valve from outside of the balloon in the direction from the top of the box to the bottom of the box; and holding means provided to retain said gas release valve in actuated position once the valve is actuated, in which said gas container defines a valve stem as part of said gas release valve, and a valve cap carried on said container and engaging said valve stem, whereby pushing of said valve cap actuates said valve stem.

6. The inflatable balloon system of claim 5 including a sleeve member between said openable top and said balloon.

7. The inflatable balloon system of claim 6 in which said container defines a curled, rearwardly-facing flange surrounding said valve stem, said valve cap defining snap-fit means that engage said flange when the valve cap is pushed into position to actuate said valve stem, whereby said valve cap is retained in the valve-actuated, gas-releasing position.

* * * * *